US005570969A

United States Patent [19]

Kamler

[11] Patent Number: 5,570,969

[45] Date of Patent: Nov. 5, 1996

[54] COMPOSITE WATERLANCE AND CAVITY CONNECTION

[75] Inventor: Frank Kamler, Ontario, Canada

[73] Assignee: The Babcock & Wilcox Company, New Orleans, La.

[21] Appl. No.: 398,202

[22] Filed: Mar. 2, 1995

[51] Int. Cl.[6] ..... F16B 11/00

[52] U.S. Cl. ..... 403/268; 122/392; 165/95; 376/316

[58] Field of Search ..... 122/390, 392, 122/405; 165/95; 376/316; 403/265, 268, 269

[56] References Cited

U.S. PATENT DOCUMENTS

| | | | |
|---|---|---|---|
| 3,507,949 | 4/1970 | Campbell | 403/268 X |
| 3,786,554 | 1/1974 | Little | 403/268 X |
| 3,932,697 | 1/1976 | Hood | 403/269 X |
| 4,407,236 | 10/1983 | Schukei et al. | 122/390 |
| 4,676,201 | 6/1987 | Lahoda et al. | 376/316 X |
| 4,769,085 | 9/1988 | Booij | 122/392 X |
| 4,827,953 | 5/1989 | Lee | 134/172 |
| 4,980,120 | 12/1990 | Bowman et al. | 376/316 |
| 5,065,703 | 11/1991 | Lee | 122/382 |
| 5,069,172 | 12/1991 | Shirey et al. | 122/382 |
| 5,092,280 | 3/1992 | Franklin et al. | 122/379 |
| 5,194,217 | 3/1993 | St. Louis et al. | 376/316 |
| 5,320,072 | 6/1994 | Theiss et al. | 122/382 |
| 5,411,043 | 5/1995 | Kamler | 134/167 R |

*Primary Examiner*—Blair Johnson
*Assistant Examiner*—Andrea Chop
*Attorney, Agent, or Firm*—Daniel S. Kalka; Robert J. Edwards

[57] ABSTRACT

An improved composite waterlance and cavity connection is described where fiber reinforcements longitudinally extend through the body (24) of waterlance (10) and are inserted into a wedge shaped cavity at the top (18*a*) and bottom (18*b*) of a front manifold (18). An adhesive in the cavity and on the end of the rope (36) fixes the rope to the front manifold (18) and to the body (24) of the waterlance (10) to provide improved strength in the connection.

13 Claims, 3 Drawing Sheets

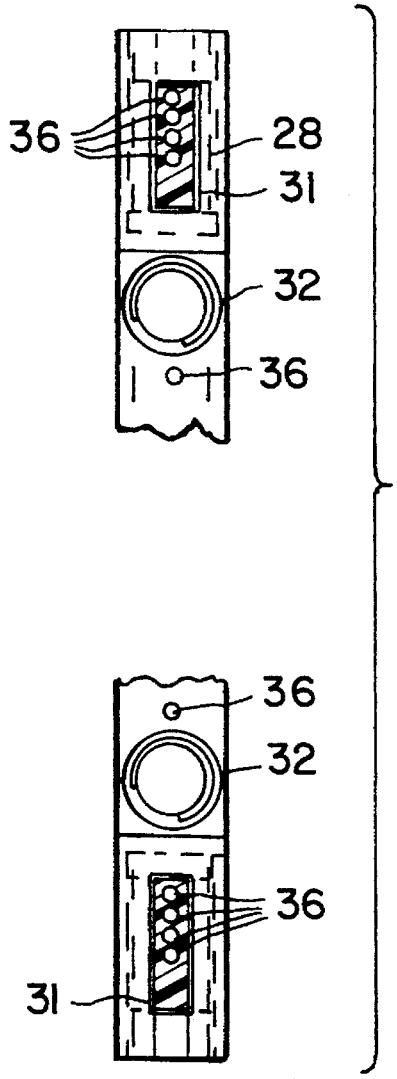
FIG.5
FIG.6
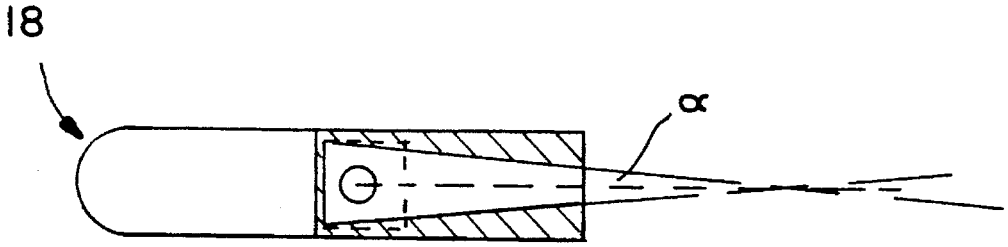

COMPOSITE WATERLANCE AND CAVITY CONNECTION

BACKGROUND OF THE INVENTION

1. Field of the Invention

The present invention relates, in general, to equipment for cleaning steam generators and, in particular, to an improved composite waterlance and cavity connection for use in a sludge lance to clean a steam generator such as a U-tube recirculating nuclear steam generator.

2. Description of the Related Art

In nuclear power stations, steam generators such as recirculating steam generators and once-through steam generators are used for heat exchange purposes to generate steam which drives turbines. Primary fluid is heated in the core of the nuclear reactor and passed through a bundle of tubes in the steam generator. Secondary fluid, generally water, is fed into the space surrounding the tubes and receives heat from the tubes converting the water into steam for driving the turbines. After cooling and condensation has occurred, the secondary fluid is directed back into the space around the tubes to provide a continuous steam generation cycle. Due to the constant high temperature and severe operating conditions, sludge accumulates on the lower portions of the tubes and on the tube sheet which supports the same. The sludge is mainly comprised of an iron oxide, such as magnetite, and reduces the heat transfer efficiency of the tubes as well as causing corrosion. Thus, the tubes must be cleaned periodically to remove the sludge. Various types of apparatus and methods are available to accomplish this task. The sludge build up is extremely difficult to remove and concentrated high pressure fluid streams are used to remove this sludge using a sludge lance from either a no-tube lane or annular opening of the boiler. Pressures of about 8,000–10,000 psi at the spray nozzle are normal. Due to the tight space constraints and the narrow spacing between the tubes or intertube lanes in a steam generator, the sludge lance requires a waterlance of a very narrow construction that can pass between the tubes in the inter tube lanes of the steam generator, for example, prior art methods employed some of the following sludge lances.

U.S. Pat. No. 4,980,120 entitled "Articulated Sludge Lance" and assigned to the assignee of the present invention, discloses an articulated lance for cleaning sludge located between steam generator tubes. In operation, the lance is inserted through a handhole into a lane or space between tubes in a tube bundle.

U.S. Pat. No. 5,194,217 entitled "Articulated Sludge Lance With A Movable Extension Nozzle" is also assigned to the assignee of the present invention and discloses an articulated sludge lance with a retractable movable extension nozzle.

In addition, U.S. Pat. No. 4,407,236 Schukei, et al discloses a thin strip of spring steel which enters a tube lane for sludge lance cleaning for nuclear steam generators. The forward ends of the capillary tubes located on the spring steel strips are directed downward for the jetting of fluid under high pressure.

U.S. Pat. Nos. 4,827,953 and 5,065,703 both to Lee are directed to an automated flexible lance for steam generator secondary side sludge removal. These patents disclose a flexible lance having a plurality of hollow, flexible tubes extending lengthwise along the flexible member to a front manifold. There are a plurality of nozzles at an end of the flexible members with the flexible member being configured to go into the difficult to access geometry of the steam generator.

The present invention through experience in this technology has found that it is desirable to anchor a front manifold to a fiber reinforced plastic material for construction of the waterlance which may be used in a sludge lance device as described in U.S. Pat. Nos. 4,980,120 or 5,194,217. Due to safety reasons, none of the components of the sludge lance device which includes the waterlance and the front manifold can be lost within the tight quarters and the difficult to access geometry of the steam generator. Very remote locations of a steam generator would make retrieval nearly impossible.

Thus, there is a need for an improved composite waterlance with a cavity connection design for firmly anchoring the front manifold thereto. This design should still fit within the tight space constraints between the tubes and effectively clean the tube lanes of a steam generator without losing any component of the waterlance including the front manifold within the steam generator.

SUMMARY OF THE INVENTION

The present invention is directed to solving the aforementioned problems associated with the prior art as well as others by providing an improved composite waterlance and cavity connection of the front manifold to the waterlance.

In accomplishing this, the present invention creates a cavity inside the front manifold at its top and bottom edges on the waterlance side with a wedge shaped pattern and fixes a reinforced fiber rope therein. The wedge shaped pattern provides a stronger connection than the prior art pin attachments.

Accordingly, one aspect of the present invention is to provide an improved composite waterlance and cavity connection of the front manifold to the waterlance.

Another aspect of the present invention is to provide a cavity connection of the front manifold to the waterlance which will firmly hold the front manifold in place and attached to the body of the waterlance without the fear of losing the front manifold within the steam generator.

A further aspect of the present invention is to manufacture an improved composite waterlance which is simple in design, rugged in construction, and economical to manufacture.

The various features of novelty characterizing the invention are pointed out with particularity in the claims annexed to and forming a part of this disclosure. For a better understanding of the invention, the operating advantages attained by its uses, reference is made to the accompanying drawings and descriptive matter in which the preferred embodiment of the invention is illustrated.

BRIEF DESCRIPTION OF DRAWINGS

In the drawings:

FIG. 5 is a vertical view of the waterlance side of the front manifold according to the present invention; and FIG. 6 is a horizontal sectional view of the front manifold illustrating the wedge shaped cavity according to the present invention.

DESCRIPTION OF THE PREFERRED EMBODIMENTS

Figure 1:
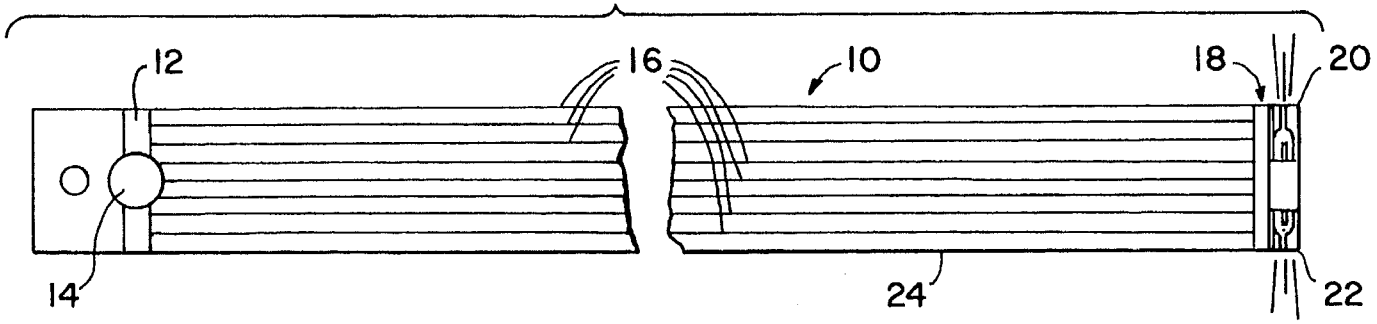
FIG. 1 PRIOR ART
FIG. 1 is a side view of a waterlance which is one component of a sludge lance removal apparatus known in the art.

Referring to the figures generally, where like numerals designate like or similar features throughout the several drawings, and to FIG. 1 in particular, there is shown a waterlance (10) which may be used with a sludge lance assembly of the type described in U.S. Pat. No. 4,980,120. The waterlance (10) is preferably intended to be used with a sludge lance device described in U.S. Pat. application Ser. No. 08/126,453 filed Sep. 24, 1993 which discloses an articulated annular sludge lance, or U.S. patent application Ser. No. 08/189,619 filed Feb. 1, 1994, which describes an automated sludge lance. Both of these patent applications are assigned to the Assignee of the present invention and hereby incorporated by reference. The term "waterlance" as employed herein is meant to include a fluid lance which delivers any fluid under high pressure from the lance (10). The waterlance (10) is substantially rectangular in cross section and is constructed to fit into retaining cross sections of a lance guide or a manipulator (not shown) which feeds the waterlance (10) into a selected tube lane from either the no-tube lane or annular opening of a steam generator or boiler (not shown).

The waterlance (10) has a rear manifold (12) to which a fluid is supplied by way of a fluid inlet (14). The rear manifold (12) communicates with a plurality of longitudinally extending spaced apart fluid tubes (16) which communicate the fluid from the rear manifold (12) to a front manifold (18). The plurality of fluid tubes (16) may be of any desired number, however, preferably, there are six such water tubes (16) having an outside diameter of approximately 0.094 inch and a wall thickness of 0.012 inch. Normally water acting as a fluid is supplied into the fluid inlet (14) supplying the rear manifold (12) at a pressure of up to approximately 10,000 psi. This pressure allows the waterlance to jet or exhaust streams of water to oppositely located nozzles (20, 22). The body (24) of the waterlance in the present invention is a plastic, preferably polyurethane, cast reinforced with fiber such as aramid fibers like KEVLAR fiber, a registered trademark of DuPont Co. Preferably, the KEVLAR fiber is about 195 denier and is braided into a rope. The preferred rope has thirteen such fibers making up a linear core with braided KEVLAR fibers wrapped around the core with four fibers to the right and four fibers to the left. The fiber reinforced lance body (24) transports the high pressure water to the front manifold (18) which contains one or more nozzles (20, 22). The waterlance (10) typically measures about 1-¼ inch by 0.115 inch thick. The waterlance (10) is preferably as stiff as possible in the 1-¼" direction to clean more effectively between the tubes in a steam generator.

Figure 2:
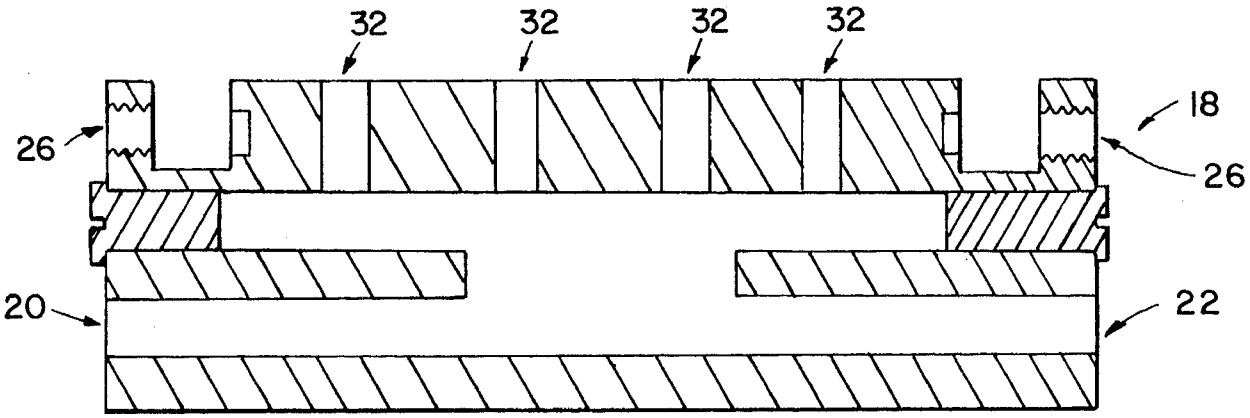
FIG. 2 PRIOR ART
FIG. 2 is a side expanded sectional view of a front manifold which employs an in-plane pin connection.
Figure 3:
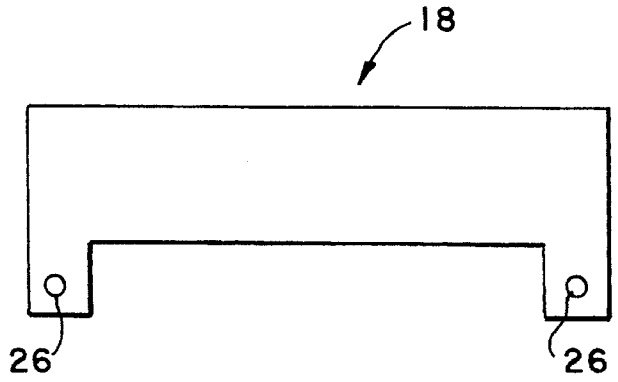
FIG. 3 PRIOR ART
FIG. 3 is a side view of a waterlance front manifold having out of plane pin connections.

In the past, the front manifold (18) was attached to the body (24) of the waterlance by way of a pin construction which could be either in or out of the plane as shown in FIGS. 2 and 3, respectively. In FIG. 2, a pin (not shown) is inserted in the opening (26) where it may be threadably engaged therein. Opening (26) is difficult to machine. A KEVLAR rope is wrapped around the pin to make a connection of the front manifold (18) with the body (24) of the waterlance (10). Tests have shown that this connection does not offer the strength necessary to ensure that the front manifold will not loosen and eventually could lodge and be lost within the steam generator. Tests have shown that approximately 80 lbs. is necessary to cause such a connection to fail. One reason believed for this failure is that KEVLAR fibers are brittle and can not be readily bent. The failure usually occurred on the bent portion wrapped around the pin. Yet, the strength of a KEVLAR rope such as a KEVLAR 1×4 rope (one rope deep by four ropes wide) is approximately 500 lbs. tensile load.

FIG. 3 shows a front manifold (18) of a waterlance (10) with an out of plane pin connection. A pin (not shown) is inserted in opening (26) perpendicular to the page and the KEVLAR rope is looped around the pin. Again, the attachment of this type of manifold presents similar problems as that of the front manifold (18) in FIG. 2.

Figure 4:
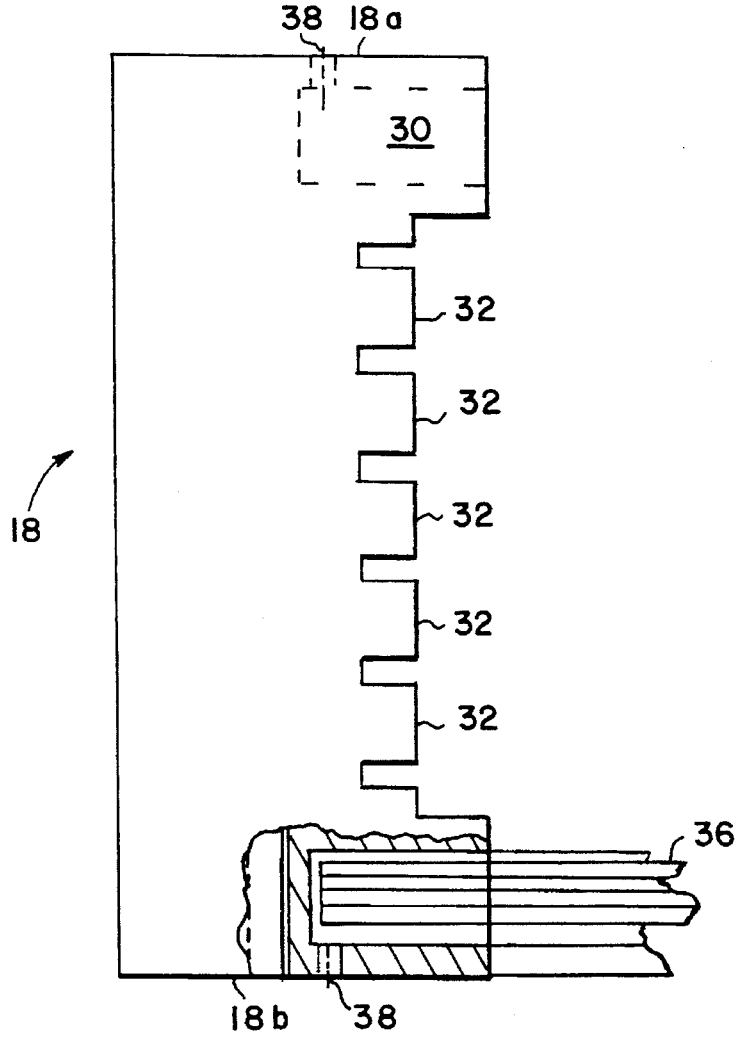
FIG. 4 is a side sectional view of a front manifold showing the cavity connection according to the present invention.

Next, referring to FIGS. 4, 5 and 6, the front manifold (18) in the present invention is directed to providing a connection that matches the strength of the fiber more closely and is easier to connect and fabricate. The present invention provides a cavity (30) which is preferably wedge shaped or has a taper and is directly machined or milled into the metal front manifold (18). The term "cavity" as used herein means the inside of an opening having a larger cross-section than the entrance to the opening. In a "hole", the inside aperture has a similar or smaller cross-sectional area than the entrance or opening. Preferably, the front manifold (18) is stainless steel and the cavity (30) is a parallel shaped cavity with a rectangular opening (31) on the rearward side of the front manifold (18) facing the body (24) of the waterlance (10). Cavity (30) is milled or machined into the top and bottom edges of the front manifold (18) for example by electrode discharge machining (EDM) techniques which for example may be manufactured by plunging a rectangular probe at different angles into the front manifold to create the wedge shape. One example of a three step method of creating a wedge shaped cavity would be during the EDM process to first cut into the front manifold with a rectangular probe at approximately a 5° angle. The second step is to plunge the rectangular probe into the front manifold at an angle of about 0° in line with the front manifold. Finally, the third step is to make a third angular cut of about −5° into the front manifold which creates the wedge shaped cavity (30) at one end of the front manifold. An opening 38 on the top of the front manifold into cavity (30) assists in flushing out the EDM material. A similar cavity would be constructed at the other end of the manifold (30) as is best seen in FIG. 4. The two cavities (30) are constructed parallel with respect to the body (24) of the waterlance (10) at the top and bottom of the front manifold (**18*a*, 18*b*) respectively. Each cavity (30) has a depth of approximately 0.235–0.250 inches with its longer side of the rectangular opening (31) ranging from 0.126–0.128 inches. The narrow side of the opening (31) would range from 0.032–0.034 inch. Preferably, cavity (30) would have an angle $\alpha$ off center as seen in FIG. 6** with $\alpha$ preferably being about 5° on each side of the taper.

In the preferred embodiment, the waterlance (10) is a polyurethane cast body (24) with at least six fluid tubes (16) extending longitudinally approximately parallel to each other therein. The fluid tubes (16) are high pressure fiber wound tubes connected to the front manifold (18) by way of openings (32). Each opening (32) connects to the fluid tube (16), for example, by having the ends of the tube (16) pressed and/or fiber wrapped onto an anchor section in the opening (32). Any other suitable high pressure fitting may also be employed. The fluid from these tubes may either pass directly through nozzles for straight ahead lancing or, alternatively, may connect with passages that direct the fluid in opposite streams from the upper (18*a*) and lower (18*b*) sides of the front manifold through nozzles (20, 22). Advantageously, in the present invention the front manifold (18) is connected to the body (24) of waterlance (10) by at least one rope (36) and preferably by a 1×4 KEVLAR rope (36) inserted about ¼ inch in each cavity (30). Rope (36) has its end coated with an adhesive such as an epoxy resin (28) and hardener or even polyurethane and is inserted into each cavity (30) which is filled with the epoxy resin and hardener, or even polyurethane. The opening (38) facilitates addition and removal of the adhesive. Connection of the front manifold (18) to the body (24) of the waterlance (10) is easily assembled by simply placing a highshear strength glue adhesive epoxy like ADBOND 5300, a registered trademark of Du Pont Co. inside the cavity (30) for example with a syringe, and on the end of the KEVLAR rope (36). The KEVLAR rope is then inserted into each cavity (30) and the adhesive is allowed to cure. When the KEVLAR rope has polyurethane on it, it is preferred to leave the ¼ inch end bare without polyurethane for better adhesion in the cavity.

The taper shape of cavity (30) along with the hardened adhesive causes the KEVLAR rope (36) to wedge as tension is placed thereon. As a result, the rope (36) is pinched tighter and does not come out of cavity (30). It has been found that the strength of the cavity connection according to the present invention is measured to be about 260 lbs. which is a much greater improvement over the 80 lb. connection achieved with the other designs of FIGS. 2 and 3. As mentioned earlier, an optional opening (38) may be drilled into the cavity (30) for facilitating injection of the adhesive and to allow the excess adhesive drain out once the rope (36) is inserted.

The cavity connection of the present invention now allows the waterlance (10) to be constructed by using preferably a one-by-four KEVLAR rope at the top of the body (24) of the waterlance which is inserted and fixed as described earlier in cavity (30) followed by a first fluid tube (16) which preferably is a fiber reinforced high pressure fluid tube followed by a single KEVLAR rope and then by another high pressure fluid tube (16) and so forth as shown in FIG. 5. Another KEVLAR rope is positioned between the second fluid tube and the third high pressure fluid tube as best seen in FIG. 5. The particular configuration of the KEVLAR ropes which are cast in polyurethane to make up the body (24) of waterlance (10) as well as the top and bottom ropes inserted and fixed to the front manifold (18) make up an improved composite waterlance according to the present invention with the required stiffness in the vertical direction and yet sufficient flexibility to pass between tubes for effective cleaning.

Another preferred embodiment for straight ahead lancing employs eight fluid tubes (16) with KEVLAR ropes (36) anchored into the body of the manifold not only at each end as described herein but also between fluid tubes (16) by machining or drilling an opening and providing threads therein. The KEVLAR rope (36) is inserted in the opening with adhesive which is also placed in the opening. After the adhesive cures, the threaded portions assist in retaining the rope in place.

While specific embodiment of the invention has been shown and described in detail to illustrate the application and principles of the invention, certain modifications and improvements will occur to those skilled in the art upon reading the foregoing description. It is thus understood that such modifications and improvements have been deleted herein for the sake of conciseness and readability but are properly within the scope of the following claims.

What is claimed is:

1. In a waterlance having a rear manifold, a fluid inlet, a plurality of longitudinally extending spaced apart fluid tubes, and a front manifold, a front manifold, comprising:

at least one wedge shaped cavity positioned at a rearward edge, said wedge shaped cavity being constructed to receive a plurality of reinforced fiber ropes, said front manifold being constructed to receive fluid tubes with a fiber reinforcement rope positioned between at least one of the fluid tubes; and means for holding said ropes in said at least one wedge shaped cavity for attaching the front manifold to a body of the waterlance.

2. A waterlance as recited in claim 1, wherein said ropes are made of aramid fibers.

3. A waterlance as recited in claim 1, wherein said wedge shaped cavity includes sides that have an angle of about 5° tapering from a center axis.

4. A waterlance as recited in claim 1, wherein the plurality of reinforced fiber ropes comprise four KEVLAR ropes.

5. A waterlance as recited in claim 1, wherein said holding means is an adhesive.

6. A waterlance as recited in claim 5, wherein said adhesive is an epoxy resin and hardener.

7. A waterlance as recited in claim 1, wherein said at least one wedge shaped cavity comprises one wedge shaped cavity each at a top and bottom edge of the front manifold.

8. A waterlance as recited in claim 7, further comprising an additional opening in each of said wedge shaped cavities for facilitating injection of an adhesive.

9. A waterlance as recited in claim 7, wherein the top and bottom wedge shaped cavities are constructed parallel with respect to the body of the waterlance.

10. A waterlance as recited in claim 7, wherein said cavities each have a depth of approximately 0.235 to 0.250 inches.

11. A waterlance as recited in claim 7, wherein said cavities are rectangular in shape.

12. A waterlance as recited in claim 11, wherein the longer side of the rectangular shape ranges from 0.126 to 0.128 inches.

13. A waterlance as recited in claim 12, wherein the narrow side of the rectangular shape ranges from 0.032 to 0.034 inches.

* * * * *